US007494201B2

(12) United States Patent
Miller

(10) Patent No.: US 7,494,201 B2
(45) Date of Patent: Feb. 24, 2009

(54) SYSTEM AND METHOD FOR REDUCING PRINTING ERRORS BY LIMITING THE FIRING FREQUENCY OF A PRINT HEAD

(75) Inventor: John P. Miller, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 287 days.

(21) Appl. No.: 10/974,582

(22) Filed: Oct. 27, 2004

(65) Prior Publication Data

US 2006/0087524 A1 Apr. 27, 2006

(51) Int. Cl.
*B41J 29/38* (2006.01)

(52) U.S. Cl. ..... 347/11; 347/5; 347/14

(58) Field of Classification Search ..... 347/11, 347/14, 5

See application file for complete search history.

(56) References Cited

U.S. PATENT DOCUMENTS 5,730,049 A 3/1998 Broschart
5,815,172 A * 9/1998 Moh ..... 347/14
6,290,325 B2 * 9/2001 Minowa et al. ..... 347/35
6,476,928 B1 11/2002 Barbour et al.
6,609,781 B2 * 8/2003 Adkins et al. ..... 347/37
6,860,585 B2 * 3/2005 Serra et al. ..... 347/40

* cited by examiner

*Primary Examiner*—Julian D Huffman
*Assistant Examiner*—Jason S Uhlenhake
(74) *Attorney, Agent, or Firm*—Brian A. Lemm; Angelo N. Chaclas

(57) ABSTRACT

A method and apparatus for printing an image on a print medium using an ink jet print head in an apparatus having an encoder system. The method includes generating a first firing pulse for the print head and starting a timer, waiting to receive an encoder signal from the encoder system and determining whether the timer has reached a preset time limit after the encoder signal is received, generating a second firing pulse for the print head if it is determined that the timer has reached the preset time limit after the encoder signal is received, and waiting for the timer to reach the preset time limit and generating a second firing pulse for the print head when the preset time limit is reached if it is determined that the timer has not reached the preset time limit after the encoder signal is received.

10 Claims, 2 Drawing Sheets

SYSTEM AND METHOD FOR REDUCING PRINTING ERRORS BY LIMITING THE FIRING FREQUENCY OF A PRINT HEAD

FIELD OF THE INVENTION

The present invention relates to a system and method for reducing printing errors in a device utilizing an ink jet print head, and, in particular, to a system and method for reducing printing errors by limiting the firing frequency of an ink jet print head in a device such as a mailing machine.

BACKGROUND OF THE INVENTION

Mail processing systems, such as, for example, a mailing machine, often include different modules that automate the processes of producing mail pieces. The typical mailing machine includes a variety of different modules or sub-systems, each of which performs a different task on the mail piece. The mail piece is conveyed downstream utilizing a transport mechanism, such as rollers or a belt, to each of the modules. Such modules could include, for example, a singulating module for separating a stack of mail pieces such that the mail pieces are conveyed one at a time along the transport path, a stripping/moistening module for stripping open the flap of an envelope, and wetting and sealing the glued flap of an envelope, a weighing module for weighing the mail piece, and a metering/printing module for storing postage amounts and applying evidence of postage either directly to the mail piece or to a tape to be applied to the mail piece. The mailing machine is controlled by a central processing unit that executes software stored in memory provided in the mailing machine. The exact configuration of the mailing machine is, of course, particular to the needs of the user.

The metering/printing modules of many current mailing machines utilize ink jet printing technology to print evidence of postage, such as postal indicia that include a 2-D barcode. Ink jet printers are well known in the art. Generally, an ink jet printer includes an array of nozzles (sometimes referred to as orifices), a supply of ink, a plurality of ejection elements (for example, expanding vapor bubble elements or piezoelectric transducer elements) corresponding to the array of nozzles and suitable driver and control electronics for controlling the ejection elements. Typically, the array of nozzles and the ejection elements along with their associated components are referred to as a print head. It is the activation of the ejection elements that causes drops of ink to be expelled from the nozzles. The ink ejected in this manner forms drops which travel along a flight path until they reach a print medium such as a sheet of paper, an envelope or the like. Once they reach the print medium, the drops dry and collectively form a print image. Typically, the ejection elements are selectively activated (energized) or not activated (not energized) to expel or not expel, respectively, drops of ink as relative movement is provided between the print head and the print medium so that a predetermined or desired print image is achieved.

Typically, the array of nozzles is disposed at an angle to the direction of movement of the print media along their respective feed paths. This is done so that the print head will print a denser image than would be obtained if the array of nozzles were disposed in a direction that is perpendicular to the direction of movement of the print media. Because of the physical size of the ejection elements that cause ink to be expelled from the nozzles, they may, in many cases, not be able to be spaced sufficiently close together to produce a clear, dense image when arranged perpendicular to the direction of movement of the print media, and by disposing them at an angle to this direction of movement and energizing the ejection elements in an appropriate sequence, the effect on the printed matter is the same as if the nozzles were to be spaced more closely together.

In addition, it is often the case that a number of so angled arrays of nozzles are utilized in one device and are arranged along an axis that is perpendicular to the direction of movement of the print media. For example, a single printing device may utilize 160 nozzles arranged in 10 arrays of 16 nozzles each, with each array being arranged, in an angled manner, along an axis that is perpendicular to the direction of movement of the print media. As will be appreciated, in such a configuration, the first nozzles from each array will be lined up with one another along the axis, the second nozzles from each array will be lined up with another along the axis, and so on. Furthermore, in such a device, the ejection elements corresponding to each of the first nozzles will be simultaneously activated or not activated, the ejection elements corresponding to each of the second nozzles will be simultaneously activated or not activated, and so on, depending on the image to be printed, under the control of the driver and control electronics of the print head.

The transport mechanism of a mailing machine also typically includes an encoder system that acts a mechanical timer for generating firing pulses for the print head and thus timing the printing operation. The encoder system includes an encoder disk that has a plurality of apertures located around its circumference, a light source and a light detector. As the transport mechanism conveys mail pieces along the mailing machine, it causes the encoder disk to rotate. The encoder disk, the light source and the encoder detector are positioned with respect to one another so that encoder disk causes the light source to be alternately blocked and unblocked as the encoder disk rotates. The transition from blocked to unblocked or vice versa results in a change of state, wherein each change of state from blocked to unblocked will indicate that a firing pulse should be generated. In such a case, the encoder system will generate a signal indicating same. Thus, as will be appreciated, the timing of the printing by the print head is tied to the movement of the mail pieces.

Two measures that customers use to evaluate mailing machines are throughput and print quality. Both of these are important to the overall operational efficiency of the mailing machine. Throughput is generally defined by the number of envelopes that the mailing machine can process over a given period of time (e.g., a number of envelopes per minute or a number of envelopes per hour). A higher rate of throughput lowers the processing cost per envelope by amortizing the cost of the mailing machine over a greater number of envelopes.

In addition, printed image quality of postal indicia is important to ensure that the postal authority promptly delivers the mail pieces and that the customer does not incur any loss of postal finds. To protect the stream of postal revenues, the postal authority is constantly on guard against fraudulent postal indicia. As a result, the postal authority inspects incoming mail pieces to determine whether or not the postal indicia are authentic representations that the postal value indicated has been properly accounted for. To perform this inspection, the postal authority requires high quality printed postal indicia so that the information contained within the postal indicia may be easily read and used to verify the integrity thereof. On the other hand, if postal indicia are poorly printed and the authenticity of thereof cannot be determined, then the associated mail pieces are likely to be returned to the sender. The return of mail pieces causes an interruption of business communications and can result in the customer losing the postal funds associated with the returned mail pieces.

The operating frequency of a print head refers to the frequency, in cycles per unit of time such as a second, at which all of the selected nozzles of an array of nozzles in the print head are sequentially activated, in response to a firing signal or pulse, to produce a desired column of drops to form part of an image. As will be appreciated, the inverse of operating frequency is the time (number of seconds) between firing pulses. Throughput, in terms of transport speed (inches per second), print quality, in terms of print resolution (dots per inch or dpi), and print head operating frequency are related to one another as follows:

$$\text{Operating Frequency}=\text{Transport Speed}\times\text{Resolution}$$

Similarly, throughput, in terms of transport speed (inches per second), print quality, in terms of print resolution (dots per inch or dpi), and time between firing pulses are related to one another as follows:

$$\text{Time Between Firing Pulses}=1/\text{Operating Frequency}=1/\text{Transport Speed}\times\text{Resolution}$$

Thus, in an ideal world, a given, required printing resolution could be maintained as transport speed is increased (to increase throughput) simply by also increasing the operating frequency of the print head. The problem, however, is that ink jet print heads, such as those used with current mailing machines, have a maximum operating frequency and a corresponding minimum time between firing pulses. In other words, for each desired column of drops to be printed by the print head, there is a minimum amount of time that it takes for each of the selected nozzles in the print head to fire (be activated and eject a drop) in response to a firing signal or pulse. The next column of drops to be printed by the print head to form the next part of the image cannot be printed until this time has elapsed. As a result, the maximum operating frequency and corresponding minimum time between firing pulses of a print head limits the speed at which mail pieces may be transported along the mailing machine (the transport speed), and therefore limits throughput.

Thus, given a required resolution and a maximum operating frequency in a particular printing application, such as a particular mailing machine that prints particular indicia, an upper transport speed limit can be determined using the equations provided above. For example, if a mailing machine printing application requires a resolution of one dot per every 0.00333 inches (approximately 300 dpi), and the mailing machine print head has a maximum operating frequency of 17.24 KHz (which corresponds to 58 microseconds between firing pulses), then the maximum transport speed that may be used in the mailing machine is approximately 57.26 inches per second (17,240 cycles per second/300 dpi). The problem, however, is that mailing machine transport mechanisms typically have a transport speed tolerance of ±10%, which means that the transport speed, if set at 57.26 inches per second, could actually range from approximately 63 inches per second to approximately 51.5 inches per second. This is problematic because the printing resolution will be decreased significantly (it will go to half density) during any periods where the maximum transport speed is exceeded. In order to avoid this problem, prior art devices and applications have set the operating transport speed of the mailing machine to some fraction of the calculated maximum transport speed described above such that, given the upper tolerance of the transport mechanism, the actual transport speed will never exceed the maximum transport speed. In the example provided above, the operating transport speed may be set to 50 inches per second, in which case the actual transport speed may go as high as 55 inches per second, which is below the calculated maximum transport speed. This prior art solution, while effective, obviously results in a lower throughput than could be achieved if the calculated maximum transport speed could be used. Thus, there is a need for a system and method for enabling the calculated maximum transport speed of a print head in a particular printing situation to be used without sacrificing resolution of the printed image in the process.

SUMMARY OF THE INVENTION

The present invention relates to a method of printing an image on a print medium using an ink jet print head in an apparatus having an encoder system for generating encoder signals. The method includes generating a first firing pulse for the print head and starting a timer. Then, the method includes waiting to receive an encoder signal from the encoder system and determining whether the timer has reached a preset time limit after the encoder signal is received. Finally, the method includes generating a second firing pulse for the print head if it is determined that the timer has reached the preset time limit after the encoder signal is received, and waiting for the timer to reach the preset time limit and generating a second firing pulse for the print head when the preset time limit is reached if it is determined that the timer has not reached the preset time limit after the encoder signal is received.

In one embodiment, the print head has a maximum operating frequency and a corresponding minimum time between firing pulses, and the preset time limit is equal to the minimum time between firing pulses. In addition, the print medium mat be transported along the apparatus at a maximum transport speed, wherein the maximum transport speed is calculated from the resolution of the image and the maximum operating frequency. Specifically, the maximum transport speed may be equal to the maximum operating frequency divided by the resolution.

The present invention also relates to an apparatus for printing an image on a print medium that includes an ink jet print head, an encoder system for generating encoder signals, a processor, and a memory. The memory stores software executable by the processor that includes instructions for generating a first firing pulse for the print head, starting a timer, waiting to receive an encoder signal from the encoder system, determining whether the timer has reached a preset time limit after the encoder signal is received, generating a second firing pulse for the print head if it is determined that the timer has reached the preset time limit after the encoder signal is received, and waiting for the timer to reach the preset time limit and generating a second firing pulse for the print head when the preset time limit is reached if it is determined that the timer has not reached the preset time limit after the encoder signal is received.

The apparatus may a mail processing system and the image may include a postal indicium. In addition, the memory and the processor may be part of a print head controller, or may alternatively be part of a micro controller system of the apparatus.

As described herein, the method and apparatus enable a calculated maximum transport speed of a print head in a particular printing situation to be used without sacrificing resolution of the printed image in the process.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PREFERRED EMBODIMENTS

Figure 1:
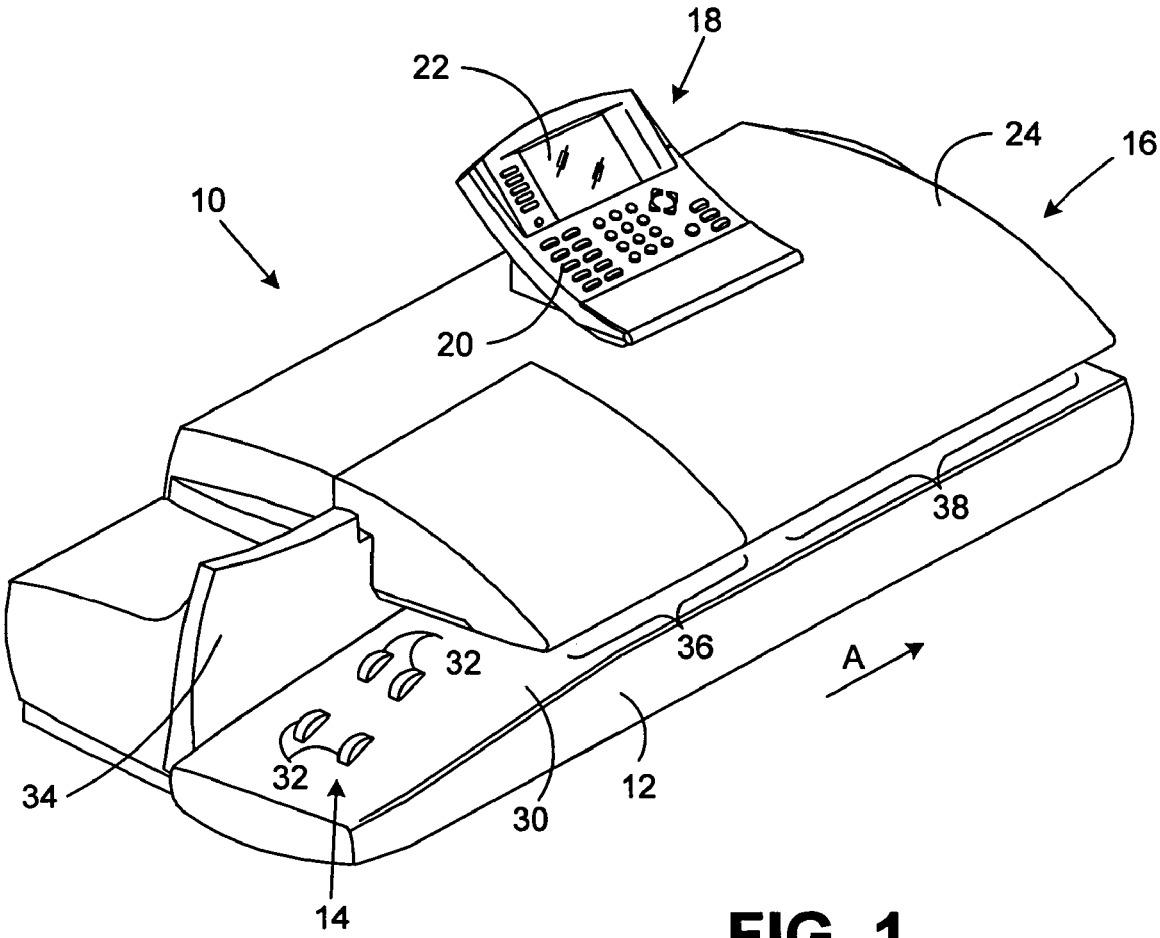
FIG. 1 is an isometric view of a mail processing system according to the present invention.

Referring to FIG. 1, an isometric view of a mail processing system 10, such as a mailing machine, according to the present invention is shown. Mail processing system 10 comprises a base unit, designated generally by the reference numeral 12, the base unit 12 having a mail piece input end, designated generally by the reference numeral 14 and a mail piece output end, designated generally by the reference numeral 16. A controller unit 18 is mounted on the base unit 12, and includes one or more input/output devices, such as, for example, a keyboard 20 and a display device 22. One or more cover members 24 are pivotally mounted on the base 12 so as to move from the closed position shown in FIG. 1 to an open position (not shown) so as to expose various operating components and parts for service and/or repair as needed.

The base unit 12 further includes a horizontal feed deck 30 that extends substantially from the input end 14 to the output end 16. A plurality of nudger rollers 32 are suitably mounted under the feed deck 30 and project upwardly through openings in the feed deck so that the periphery of the rollers 32 is slightly above the upper surface of the feed deck 30 and can exert a forward feeding force on a succession of mail pieces placed in the input end 14. A vertical wall 34 defines a mail piece stacking location from which the mail pieces are fed by the nudger rollers 32 along the feed deck 30 and into a transport mechanism (not shown) that transports the mail pieces in a downstream path of travel, as indicated by arrow A, through one or more modules, such as, for example, a separator module and moistening/sealing module. Each of these modules is located generally in the area indicated by reference numeral 36. The mail pieces are then passed to a metering/printing module (including print head controller 44 and ink jet print head 46 shown in FIG. 2) located generally in the area indicated by reference numeral 38, and exit the mailing processing system 10 at the output end 16.

Figure 2:
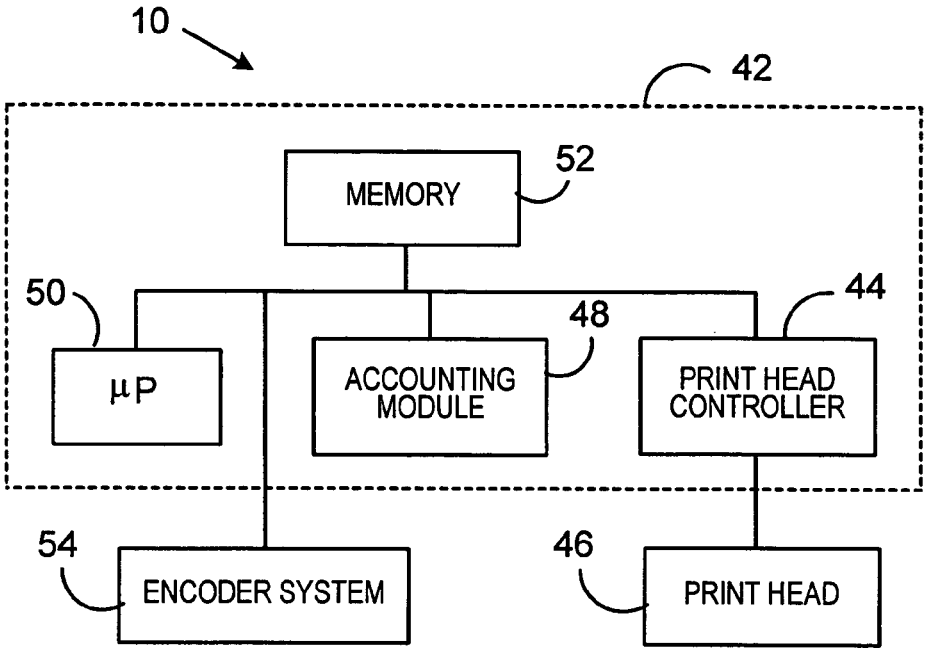
FIG. 2 is a block diagram showing certain components of the mail processing system of FIG. 1.

FIG. 2 is a block diagram showing certain components of mail processing system 10 according to the present invention. As seen in FIG. 2, mail processing system 10 includes micro control system 42 which may be of any suitable combination of microprocessors, firmware and software. The micro control system 42 includes a print head controller 44 having a suitable processor and memory which is in operative communication with ink jet print head 46, an accounting module 48 (e.g., a postage meter) for tracking postal funds, a microprocessor 50, and a memory 52. Ink jet print head 46 may be any type of ink jet print head (e.g., thermal (bubble) ink jet or piezoelectric ink jet), and includes one or more arrays of nozzles (not shown), each nozzle having a corresponding ejection element (not shown). Additionally, the micro control system 42 is in operative communication with encoder system 54 for receiving signals indicating an appropriate change of state of encoder system 54. Encoder system 54 is incorporated as part of the transport system for the mail processing system 10 and is used to generate firing pulses for the print head 46 based on the movement of the medium upon which the print head 46 is printing as is known in the art. Thus, signals from the encoder system 54 are used to generate firing pulses for ink jet print head 46. In response to the firing pulses, selected nozzles are sequentially activated, thereby ejecting ink. Those skilled in the art will recognize that the various components of the micro control system 42 are in operative communication with each other over conventional communication lines, such as a communication bus.

Figure 3:
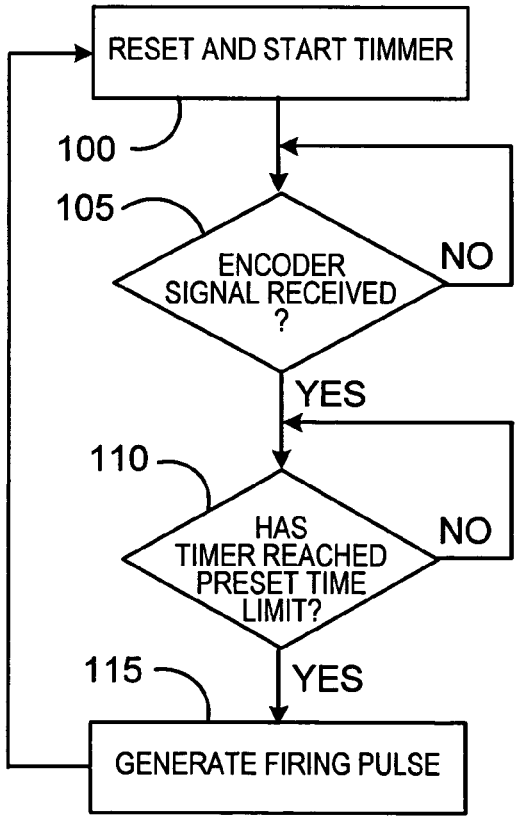
FIG. 3 is a flowchart depicting a method for reducing printing errors in the mail processing system of FIG. 1 by limiting the firing frequency of the ink jet print head forming a part thereof according to the present invention.

FIG. 3 is a flow chart of a method for reducing printing errors in mail processing system 10 by limiting the firing frequency of ink jet print head 46 according to the present invention. The method begins at step 100, where a timer is set/reset to zero and started. As will be appreciated by those of skill in the art, the timer comprises a time based clock and may be implemented in software or in hardware. Next, at step 105, a determination is made as to whether a signal from encoder system 54 has been received indicating that a firing pulse should be generated. If the answer is no, then, as shown in FIG. 3, the method continues to wait for such a signal. If, however, the answer at step 105 is yes, then, at step 110, a determination is made as to whether the timer has reached a preset time limit. The preset time limit will be equal to the minimum time between firing pulses for ink jet print head 46, which, as described above, is the inverse of the maximum operating frequency of ink jet print head 46. If the answer is no, then, as shown in FIG. 3, the method continues to wait for the preset time limit to be reached. If, however, the answer at step 110 is yes, then, at step 115, a firing pulse for ink jet print head 46 is generated, which, as described above, will result in selected nozzles in ink jet print head being activated to generate a desired column of drops forming a part of the image to be printed. Next, the method returns to step 100, where the timer is reset and started.

Thus, according to the method shown in FIG. 3, firing pulses for ink jet print head 46 will be generated: (i) at the time encoder signals are received only in cases where the encoder signals are received more than the preset time limit after the previous firing pulse, and (ii) when the preset time limit has elapsed in cases where encoder signals are received less than or equal to the preset time limit after the previous firing pulse. As a result, the method ensures that no firing pulses will be generated too soon after the previous firing pulse, i.e., before the minimum time between firing pulses for ink jet print head 46 has elapsed, and thus enables the transport mechanism of mail processing system 10 to be operated at the calculated maximum transport speed that is based on a given resolution and the maximum operating frequency of ink jet print head 46. For example, if particular printing situation requires a resolution of one dot per every 0.00333 inches (approximately 300 dpi), and ink jet print head 46 has a maximum operating frequency of 17.24 KHz (which corresponds to 58 microseconds between firing pulses), then the preset time limit may be set to 58 microseconds and mail processing system 10 may be operated at the maximum transport speed of approximately 57.26 inches per second without significant adverse effect on the resolution of the printed image.

As will be appreciated, the method shown in FIG. 3 may be implemented in software, firmware or the like that is stored in memory 52 and executed by microprocessor 50, or, alternatively, that is stored in memory 52 or the memory of print head controller 44 and executed by the processor of print head controller 44.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. For example, while the method of the present invention has been described in connection with a mail processing system such as a mailing machine, the method may also be implemented in any other device that uses an ink jet print head and transports print media past the ink jet print head for printing. Accordingly, the invention is not to be considered as limited by the foregoing description but is only limited by the scope of the appended claims.

What is claimed is:

1. A method of printing an image on a print medium using an ink jet print head in an apparatus having an encoder system for generating encoder signals, comprising:

generating a first firing pulse for said print head in response to receiving a first encoder signal from said encoder system, said first firing pulse activating selected nozzles of said print head to eject ink to form a first portion of said image;

starting a timer in response to said first firing pulse being generated to determine when a preset time limit is reached;

receiving a second encoder signal from said encoder system;

generating a second firing pulse for said print head in response to receiving said second encoder signal to activate selected nozzles of said print head to eject ink to form a second portion of said image if said timer has reached said preset time limit before said second encoder signal is received; and waiting for said timer to reach said preset time limit and generating a second firing pulse for said print head to activate selected nozzles of said print head to eject ink to form a second portion of said image when said preset time limit is reached if said timer has not reached said preset time limit before said second encoder signal is received.

2. A method according to claim 1, said print head having a maximum operating frequency and a corresponding minimum time between firing pulses, said preset time limit being equal to said minimum time between firing pulses.

3. A method according to claim 2, said print medium being transported along said apparatus at a transport speed and said image having a resolution, wherein said transport speed is calculated from said resolution and said maximum operating frequency.

4. A method according to claim 3, wherein said transport speed is equal to said maximum operating frequency divided by said resolution.

5. An apparatus for printing an image on a print medium, comprising:

an ink jet print head;

an encoder system for generating encoder signals;

a processor; and a memory, said memory storing software executable by said processor, said software including instructions for:

generating a first firing pulse for said print head in response to receiving a first encoder signal from said encoder system, said first firing pulse to activate selected nozzles of said print head to eject ink to form a first portion of said image;

starting a timer in response to said first firing pulse being generated to determine when a preset time limit is reached;

receiving a second encoder signal from said encoder system;

generating a second firing pulse for said print head in response to receiving said second encoder signal to activate selected nozzles of said print head to eject ink to form a second portion of said image if said timer has reached said preset time limit before said second encoder signal is received; and waiting for said timer to reach said preset time limit and generating a second firing pulse for said print head to activate selected nozzles of said print head to eject ink to form a second portion of said image when said preset time limit is reached if said timer has not reached said preset time limit before said second encoder signal is received.

6. An apparatus according to claim 5, said print head having a maximum operating frequency and a corresponding minimum time between firing pulses, said preset time limit being equal to said minimum time between firing pulses.

7. An apparatus according to claim 6, further comprising a transport mechanism for transporting said print medium along said apparatus at a transport speed, said image having a resolution, wherein said transport speed is calculated from said resolution and said maximum operating frequency.

8. An apparatus according to claim 7, wherein said transport speed is equal to said maximum operating frequency divided by resolution.

9. An apparatus according to claim 5, said apparatus being a mail processing system and said image including a postal indicium.

10. An apparatus according to claim 5, said memory and said processor being part of a print head controller.

* * * * *